US005178745A

United States Patent [19]

Abys et al.

[11] Patent Number: 5,178,745

[45] Date of Patent: Jan. 12, 1993

[54] ACIDIC PALLADIUM STRIKE BATH

[75] Inventors: Joseph A. Abys, Warren; Heinrich K. Straschil, Summit, both of N.J.

[73] Assignee: AT&T Bell Laboratories, Murray Hill, N.J.

[21] Appl. No.: 695,159

[22] Filed: May 3, 1991

[51] Int. Cl.[5] ..... C25D 3/52

[52] U.S. Cl. ..... 205/219; 205/170; 205/265

[58] Field of Search ..... 205/265, 257, 219, 210, 205/170

[56] References Cited

U.S. PATENT DOCUMENTS

| | | | |
|---|---|---|---|
| 4,098,656 | 7/1978 | Deuber | 205/265 |
| 4,406,755 | 9/1983 | Morrissey | 205/265 |
| 4,454,010 | 6/1984 | Trop | 205/265 |
| 4,486,274 | 12/1984 | Abys et al. | 205/265 |
| 4,491,507 | 1/1985 | Herklotz et al. | 205/265 |
| 4,511,798 | 3/1990 | Abys et al. | 205/265 |
| 4,552,628 | 11/1985 | Wilcox et al. | 205/265 |
| 4,673,472 | 6/1987 | Morrissey et al. | 205/265 |
| 4,778,574 | 10/1988 | Mathe et al. | 205/265 |

FOREIGN PATENT DOCUMENTS

| | | |
|---|---|---|
| 55-175874 | 9/1982 | Japan . |
| 57-30024 | 11/1983 | Japan . |

*Primary Examiner*—John Niebling
*Assistant Examiner*—Brian M. Bolam
*Attorney, Agent, or Firm*—Oleg A. Alber

[57] ABSTRACT

This invention is an acid palladium strike bath which improves adhesion and porosity of subsequent platings of palladium or palladium alloys on metal substrates, especially those susceptible to passivation such as nickel, chromium, bronze and steel. The acid palladium strike bath which is useful for both low-speed and high speed plating operation includes a complexing agent selected from organic diamines and has a pH ranging from 2.0 to 6.0, preferably from 3.7 to 4.1. When used on easily corrodable substrates, such as copper, the palladium strike deposit protects the parts from chemical attack in the subsequent mainplating bath and prevents its contamination.

23 Claims, 1 Drawing Sheet

ACIDIC PALLADIUM STRIKE BATH

TECHNICAL FIELD

This invention is concerned with palladium strike plating for improving adhesion and porosity of palladium, palladium alloys and other precious metals plated on metal surfaces, especially surfaces susceptible to passivation.

BACKGROUND OF THE INVENTION

One way to achieve good adhesion of plated deposits on passivated metal substrates is by chemical activation, that is by removal of a passivating film by chemical means, such as by acids, prior to plating the surface. However, the success of this method depends on the speed at which repassivation will occur in relation to the time interval between activation and plating. Furthermore, the use of chemical activation may result in contamination of the next plating bath with drag-in of ingredients of the activating bath.

Strike plating may be used as an alternative way of achieving good adhesion of plated deposits on metal substrates to be plated. Strike plating is a deposition of a very thin film of fine nuclei of a selected metal over the surface of a metal substrate to be plated. Strike plating serves to improve adhesion of an electrodeposit on a substrate, especially on a passivated substrate, to protect the main plating bath from contamination by corrosion products of the metal substrate, and to diminish drag-in from previous operations. It can also lead to a reduction in the porosity of subsequent plating coatings, especially of thinner coatings (i.e., <50 microinches). Therefore, the strike plating seems to be a more advantageous alternative.

Strike baths adapted for different surfaces and platings are in commercial use throughout the electroplating industry. For instance, highly acidic nickel strike baths (e.g., Wood's nickel) are used on nickel, stainless steel and cobalt alloys, among others; acid gold strike is used as a preplate on nickel and other substrates before gold or other precious metals, including palladium and platinum; silver strike is used before silver plating; copper strike baths have many applications ranging from lead and beryllium alloy to low-carbon and stainless steel substrates for better adhesion, and on zinc and zincated metals for corrosion protection.

Acid palladium electroplating baths apparently found no commercial use. Highly acidic palladium baths attack the substrate and may cause metal displacement, which is undesirable. In the pH range of from 2 to 7, palladium baths lead to co-deposition of hydrogen with possible cracking of the deposits.

Often the strike and the subsequent plating are not of the same metal; however, bonding is better when the deposit has the same or a similar crystallographic structure, which allows epitaxial growth. Therefore, it is desirable to provide a palladium strike chemistry for plating of palladium and palladium alloys on metal surfaces other than palladium and palladium alloys.

U.S. Pat. No. 4,098,656 issued on Jul. 4, 1978 to John Martin Deuber discloses a palladium bath containing Pd as $Pd(NH_3)_2Cl_2$, EDTA and two brighteners (Class I-unsaturated sulfonic compounds and Class II-unsaturated or carbonyl organic compounds), the bath having a pH value from 4.5 to 12. It is suggested that the bath with palladium content of from 0.1 to 5 g/l and with pH of 4.5–7, preferably 6.5, could be used for strike plating. However, it seems that this bath has also found no commercial use. This may be explained by its being not suitable for in-line plating because it decomposes easily. While freshly prepared baths are stable, during the plating operation EDTA undergoes oxidation and/or reduction at the electrodes with formation of compounds which can reduce Pd in the solution and subsequent precipitation of Pd from the solution.

Therefore, there is still a need for an acid palladium strike bath which could remove or at least reduce the passivation of a surface to be plated and to present a surface readily plateable by subsequent palladium or palladium alloy baths, and which results in better adhesion than chemical activation (acid pickle).

SUMMARY OF THE INVENTION

This invention is an acid palladium strike bath chemistry which improves both the adhesion and the porosity of subsequent platings of palladium or palladium alloy such as palladium-nickel alloy on nickel and other substrates, especially those susceptible to passivation. The acid palladium strike bath which is useful for both low-speed and high-speed plating operation, includes a complexing agent selected from a group of organic diamines and has a pH ranging from 2.0 to 6.0, preferably from 3.0 to 4.3, most preferably from 3.7 to 4.1. Strike plating applied from this bath to a passivated substrate, effectively prevents repassivation of the surface even if the strike plated sample is stored dry for prolonged intervals after the strike. Adhesion of palladium-nickel deposited on nickel substrate using this strike chemistry has been found superior to the adhesion obtained either without any activation or with chemical activation of the nickel substrate. The acid palladium strike also improves the porosity of subsequent palladium or palladium-nickel plating. Thin coatings of palladium and palladium alloys, such as palladium/nickel, on nickel exhibited considerably lower porosity when the acid palladium strike was applied before palladium or palladium alloy plating, than without strike. When used on easily corrodable substrates (e.g., copper) the palladium strike protects the parts from chemical attack in the main bath and prevents its contamination.

The acid palladium strike has been applied successfully to metals such as nickel and bronzes directly; some stainless steels require a special pretreatment. Its use in combination with gold, rhodium, ruthenium and other precious metal platings is possible. The acid palladium strike baths can be made up and replenished from concentrates. The bath retained its coating capability even after a sizeable amount of Pd (relative to the starting bath) was plated from the periodically replenished bath.

The chemistry described hereinbelow for both the high-speed and the low-speed acid palladium strike baths is expected to find wide acceptance in industry for electroplating of palladium and palladium alloys over easily passivated surfaces, such as chromium, nickel, bronze, steels, and others. This will be especially true for such operations as barrel plating, where optimum process control and repeatability are not always present. The electronics industry should also profit from the improvement in porosity achieved by preplating with the acid palladium strike bath since it increases the life of the plated parts, specifically electrical contacts and connectors in a hostile environment. Also the decorative industry could benefit from this improvement—for instance, on jewelry—which would enhance the quality of the product while reducing the cost.

DETAILED DESCRIPTION

Figure 1:
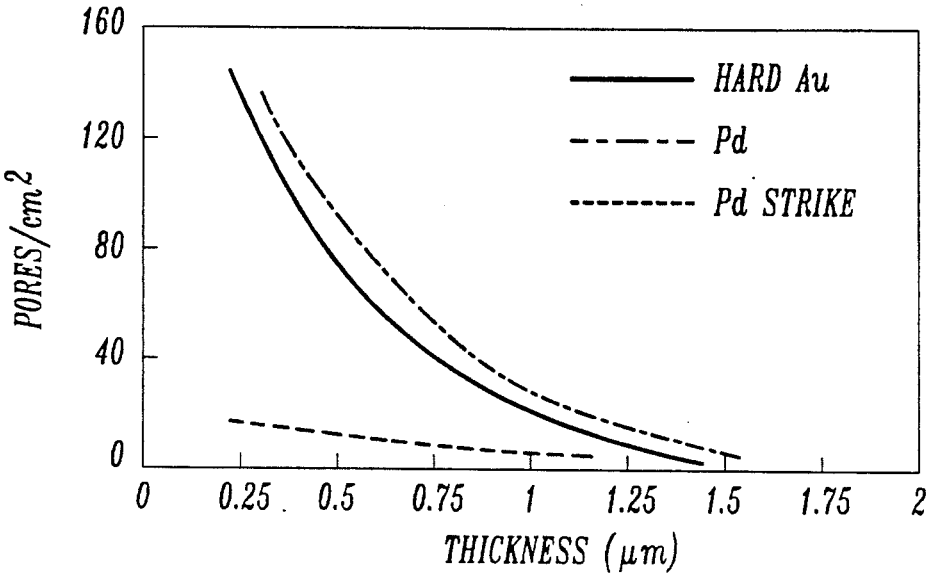
FIG. 1 is a schematic representation of number of pores per square centimeter versus the thickness of palladium plating with and without palladium strike.

This invention is a chemical formulation which exhibits good chemical and electrochemical stability in the pH range of from 2.0 to 6.0, preferably from 3 to 4.3, more preferably from 3.5 to 4.3, and most preferably from 3.7 to 4.1, contains a complexing agent for palladium, which in combination with certain organic acids provides high buffer capacity in this pH range. An adequate supply of chloride-containing supporting electrolyte and small amounts of additives complete the bath chemistry.

Two formulations of the acid palladium strike bath and their operating parameter ranges and preferred parameters, one for low-speed plating and another for high-speed plating, are shown in Table I below. Intermediate ranges of bath formulations and operating parameters are also useful.

TABLE I

| | Low-Speed | | High-Speed | |
|---|---|---|---|---|
| | Range | Preferred | Range | Preferred |
| Pd, g/l | 0.1-5 | 3 ± 1 | 5-30 | 10 ± 2 |
| Supporting Electrolyte, g/l | 10-100 | 60 | 20-200 | 60 |
| Complexing Agent, g/l | 1-50 | 40 | 50-250 | 65 |
| Buffering Agent, g/l | 20-200 | 150 | 200-350 | 250 |
| Additive, ppm | 0-50 | 1 | 0-50 | 1 |
| Bath temperature, °C. | 25-75 | 45 ± 5 | 25-75 | 45 ± 5 |
| pH | 2.0-6.0 | 3.9 ± 0.2 | 2.0-6.0 | 3.9 ± 0.2 |
| Current Density, mA/cm2 | 0.1-10 | 5 ± 1 | 10-250 | 50 ± 10 |

Palladium can be added to the bath in the form of simple or complex salts which include at least the following: palladium dichloride, $PdCl_2$; palladium dibromide, $PdBr_2$; palladium sulfate, $PdSO_4.2H_2O$; palladium nitrate, $Pd(NO_3)_2$; palladium monoxide hydrate, $PdO.xH_2O$; diamminepalladium(II)hydroxide, $Pd(NH_3)_2(OH)_2$; dichlorodiamminepalladium(II), $Pd(NH_3)_2Cl_2$; dinitritodiammine-palladium(II), $Pd(NH_3)_2(NO_2)_2$; tetramminepalladium(II)chloride, $Pd(NH_3)_4$ $Cl_2.H_2O$; tetramminepalladiumtetrachloropalladate, $Pd(NH_3)_4.PdCl_4$; and others. In order to expedite dissolving and mixing, it is preferable to react these palladium compounds, before they are added to the bath, with the same complexing agent as is used in the bath.

Supporting electrolytes are preferably selected from sodium chloride, potassium chloride, and ammonium chloride. Other salts such as alkali metal and ammonium bromides, sulfates, nitrates and others can also be used. Chlorides are preferred because of the stability of chloride ion under conditions of the electroplating process.

Organic diamines selected from 1,2-diaminobutane, 1,2-diaminopropane; 1,2-diamino-2-methylpropane; 1,2-diaminopentane; 1,2-diaminohexane; 2,3-diaminobutane, 2,3-diaminopentane; 2,3-diaminohexane; 3,4-diaminohexane and higher aliphatic diamines with adjacent primary, secondary or tertiary amino groups are usable as the complexing agent. The preferred complexing agent according to this invention is 1,2-diaminopropane.

Acetic acid/acetate is the preferred buffering agent because of its low price. Acetic acid is added as glacial acetic acid, and acetate is formed when the alkaline mixture of the palladium complex and free complexing agent is neutralized with acetic acid. More acetate can be added in the form of sodium, potassium or ammonium acetate. Other acids such as citric acid, tartaric acid, tetraboric acid, acetoacetic acid, chloroacetic acid, malic acid, maleic acid, itaconic acid and many other sufficiently water-soluble acids in combination with their anions can also be used as buffering agents.

The additives include non-ionic and cationic surfactants, typically polyethylene glycols and fluorinated alkyl quaternary ammonium halides, such as fluorinated alkyl quaternary ammonium iodide.

Periodic monitoring of the palladium content is essential for uniform operation. Atomic absorption analysis may be used to monitor the palladium level in the bath; other methods (e.g., gravimetric) are also applicable. For metal replenishment, a replenisher concentrate (typically 100 g/l Pd) is added, which assures easy blending with the bath. The pH of the bath is affected very little, if at all, when the replenisher is added.

Temperature control is neither critical nor difficult; control within ±5° C. of the bath temperature is quite sufficient. Higher temperature increases the cathode current efficiency, within the given temperature range this change does not affect the function of the strike.

The baths are well buffered and pH control is not difficult. The pH of the bath is maintained within a range of from 2.0 to 6.0 with 3.5 to 4.3 being preferable, 3.7 to 4.1 being more preferable and 3.9 being the most preferable. The pH has little effect on the current efficiency and rises very slowly during the bath operation. Adjustment is made by adding concentrated hydrochloric acid for lowering and potassium hydroxide or sodium hydroxide for raising the pH. All the given pH values refer to room temperature.

Improved adhesion of the subsequent alloy deposit on the strike-coated surface is the primary objective of the strike baths. For its evaluation, two different methods of adhesion testing, the Bend Test and the Tape Test, were used as described hereinbelow. Most test plating was performed on 2-mil ($5.1\times10^{-3}$ cm) thick copper foil coupons (15 $cm^2$) wrapped around a stainless steel cylinder (2 cm in diameter) rotating in the test bath about its longitudinal axis. For adhesion testing, a layer of 100 microinches (2.54 μm) thick nickel was deposited on the copper foil from a nickel sulfamate bath. After specified sequences of activation steps, made for comparison purposes, as shown in Table II (no activation, acid pickle, or strike plating; different delay times; wet or dry), a 100 microinch (2.54 μm) thick coating of palladium-nickel alloy was plated on the nickel coated coupon from a proprietary bath. When the test plating was performed on bronze or stainless steel flat sheet coupons, these coupons were hand-agitated in the baths. The bath for deposition of palladium-nickel alloy is described in U.S. Pat. No. 4,486,274, issued on Dec. 4, 1984 to Abys, J. A. et al or in U.S. Pat. No. 4,911,798 issued on Mar. 27, 1990 to Abys, J. A. et al., both of which are incorporated herein by reference.

The plated foils then were subjected to a number of testing procedures including a Bend Test and a Tape Test. The results are shown in Table I. In the "Activation" column of the Table, "none"—means that samples underwent no activation, "pickle"—means that samples were subjected to an acid pickle activation in 10 wt-% HCl for 15 minutes at room temperature, and "strike" means that samples were subjected to the acid palladium strike bath, at low-speed, 40° C., pH 3.9, 5 mA/cm$^2$, for 90 sec. Samples marked "W" were kept immersed in distilled water during the given time interval; samples marked "D" were exposed to the ambient (laboratory) atmosphere; samples marked "D*" were exposed to the ambient (laboratory) atmosphere and then degreased with acetone before further processing.

For the Bend Test, the palladium-nickel alloy plated foils were tightly folded (180 degrees) with the deposit being on the outside, pressed together at the bend causing a break in the deposit layers, and then unfolded with a small ridge remaining at the bend site. The crest of the ridge was inspected microscopically; both optical and scanning electron microscopy were used. To rate the adhesion as determined by the Bend Test, an arbitrary scale from 1 to 4 was introduced as follows: 1—if deposit separates spontaneously before bending, 2—if a separation occurs along the whole bending crack, 3—if there is some separation and some adherence along the bending crack, and 4—if no separation at all between substrate and deposit occurs.

The Tape Test involves affixing a piece of an adhesive tape (e.g. transparent type) to the plated surface, pressing it down by rubbing with the thumb, and pulling the tape off. If the deposit adheres to the tape (even in part) the sample has failed the test (mark "F"); if the deposit remains on the substrate the sample has passed (mark "P").

TABLE II

ADHESION TEST RESULTS

| Time After Ni Plate | Wet/ Dry | Acti- vation | Time before PdNi Plate | Wet/ Dry | Adhesion Bend | Test Tape |
|---|---|---|---|---|---|---|
| 30 sec | W | none | none | — | 2 | F |
| 10 min | W | none | none | — | 2 | F |
| 10 min | D | none | none | — | 1 | F |
| 30 sec | W | pickle | 30 sec | W | 3 | F |
| 10 min | W | pickle | 30 sec | W | 2 | F |
| 10 min | D | pickle | 30 sec | W | 2 | F |
| 1 day | D* | pickle | 30 sec | W | 2 | P |
| 1 week | D* | pickle | 30 sec | W | 2 | P |
| 10 min | W | strike | 10 min | W | 4 | P |
| 10 min | D | strike | 10 min | W | 4 | P |
| 10 min | D | strike | 10 min | D | 4 | P |
| 1 day | D* | strike | 10 min | D | 4 | P |
| 1 week | D* | strike | 1 day | D* | 4 | P |

SEM micrographs at 35× and 100× magnification of examples with 2-rated adhesion showed that the deposit lifted off the substrate on either side of the bend ridge about ½ to 1 mm wide. In contrast, SEM micrographs at the same modification of examples with 4-rated adhesion showed perfect adhesion even of very small sections between two crack lines. Among the listed samples, only the ones treated with the acid palladium strike showed perfect (4-rated) adhesion. SEM micrographs of examples with 4-rated adhesion taken at 1000× and 6000× magnification disclosed that, even at such large magnification, plated layers of nickel and palladium-nickel can be discerned appearing firmly bonded to each other even at such large magnification.

Acid pickle was somewhat effective when the time lapse between preparation steps was short and the foils were kept under water (out of contact with atmosphere). No satisfactory adhesion was obtained without activation. Similar tests were performed on nickel substrates plated with the high-speed acid palladium strike bath, with perfect adhesion in all trails.

Similar tests were performed on several acid palladium strike-activated bronzes and stainless steels. In general, it was found that for P and Be bronzes, acid Pd strike is recommended; for lead bronzes, Pd strike was useful but substrate may require pretreatment. For stainless steels, Pd strike would be also useful with special preparation of stainless steel surfaces; for example, the following sequence of steps may be of use prior to palladium or palladium alloy plating: soaking the stainless steel surface in hot alkaline cleaning solution, followed by cathodic degreasing, cathodic activation (10% $H_2SO_4$+5% acetic acid) and acid palladium strike. Each of these steps is followed by a water rinse.

The low-speed acid strike bath was used on square contact pins in a barrel-plating operation. The pins used were of connector copper alloy with an consecutively plated as follows:

| | |
|---|---|
| Nickel plate | 4.0 μm |
| Acid palladium strike | 0.125 μm |
| Palladium plate | 0.25–1.5 μm |
| Hard gold plate | 0.125 μm |

For test purposes, the palladium thickness was varied over the specified range.

The test lots were compared to similar lots that were plated without the acid palladium strike. The porosity was evaluated using Western Electric Manufacturing Standard 17000, Section 1310, which is a variation of ASTM Method B 799, "Porosity in Gold and Palladium Coatings by Sulfurous Acid/Vapor". This method exposes the plated parts to an atmosphere which is corrosive to underlying nickel or copper so that products are generated in spots where pores are present in the coatings. These spots can be counted and used as a gauge in determining the relative corrosion protection.

FIG. 1 compares pore counts per square centimeter obtained with and without the acid palladium strike at palladium plate thicknesses ranging from 0.25 to 1.25 micrometers. At 0.25 μm thickness the pore count drops from ~200 pores/cm$^2$ without the use of strike to ~25 pores/cm$^2$ when the strike is used; the improvement extends to greater plating thicknesses until the reference sample is also virtually pore-free. For further comparison, FIG. 1 also contains the pore count of hard gold plated on nickel as a function of plating thickness.

Figure 2:
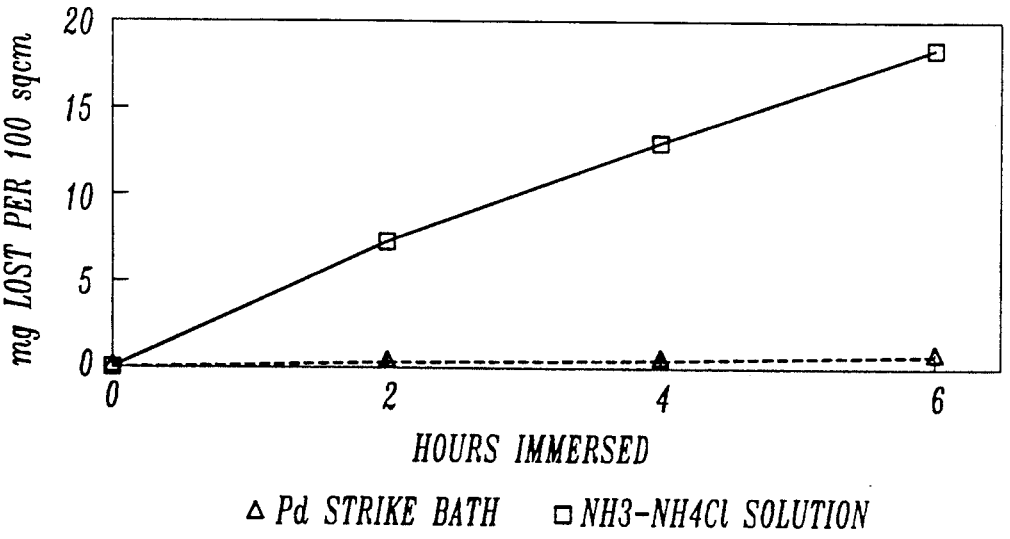
FIG. 2 is a schematic representation of corrosion effects on a copper substrate for the strike bath and for an ammonia/ammonium chloride solution (pH=8) expressed as mgs lost per 100 square centimeters versus immersion time.

For testing substrate corrosion effects of the acid palladium strike bath on a substrate to be subjected to the strike bath, a copper coupon was immersed in the high-speed acid palladium strike bath (pH=3.9) at room temperature for six hours; in a parallel test, an equal coupon was immersed in an ammonia/ammonium chloride (1M) solution with pH=8. Both baths were kept at room temperature (23° C.). In FIG. 2 are shown respective weight losses after 2, 4 and 6 hours immersion. The acid strike bath according to this invention is less corrosive to copper substrate than the ammonia/ammonium chloride solution by a factor of >20.

To determine resistance of the acid palladium strike bath to aging, a sample of high-speed acid palladium strike bath was aged until 20 g Pd per liter were plated out from the bath; After 10 and 20 g/l Pd had been plated out, nickel-coated copper foils were strike-plated in the test bath and then plated with palladium-nickel alloy. Both samples showed perfect 4-rated adhesion and passed the tape test.

The following examples describe experiments which further demonstrate the efficacy of the acid palladium strike bath. Unless otherwise stated, various materials, concentrations, dimensions, operating conditions and other parameters are provided by way of illustration and are not intended to limit the scope of the invention.

EXAMPLE 1

A coating of 2.5 μm thick nickel was electroplated from a commercially available nickel sulfamate plating bath onto a 50 μm thick copper foil coupon of 15 $cm^2$ area. The nickel sulfamate plating bath contained approximately 400 g/l nickel sulfamate and 30 g/l boric acid, and had a pH of 4.5; a soluble nickel anode was used; the temperature of the bath was 55° C., the cathode current density was 1 $A/dm^2$, and the agitation speed was 100 cm/second. The plated coupon was rinsed, dried and exposed to the laboratory atmosphere for 9 days. After this period, the test coupon was degreased with acetone and strike-plated in a low-speed bath according to this invention, for 90 seconds at 40° C., a cathode current density of 0.5 $A/dm^2$ and an agitation speed of 50 cm/second. The strike bath with a pH of 3.9 contained 1 g/l Pd, 5.4 ml/l of 1,2-diaminopropane, 23.3 ml/l glacial acetic acid, 60 g/l sodium chloride and 1 ppm of a cationic surfactant (a fluorinated alkyl quaternary ammonium iodide).

After the Pd strike plating, the coupon was dried and kept at the laboratory atmosphere for 10 minutes. Then it was electroplated with a 2.4 μm thick layer of palladium-nickel alloy (ca. 20 wt-% nickel) at 45° C., 10 $A/dm^2$ and 300 cm/second agitation speed in an ammonia-based commercial bath. The deposit of palladium-nickel alloy adhered perfectly to the nickel undercoating. When inspected at 1000× and 6000× magnification through a scanning electron microscope, there was no separation between the nickel and the palladium-nickel layers after folding the foil back sharply 180° (causing the deposit layers to crack).

For comparison, a similar nickel-plated copper foil was treated in the same way but without the application of a palladium strike between the nickel and the palladium-nickel coating. It showed no adhesion at all between the nickel and the palladium-nickel layers; rather, the palladium-nickel coating flaked off spontaneously.

EXAMPLE 2

A sample was prepared similarly to the one in Example #1, but was exposed to the laboratory atmosphere for a full day after the palladium strike was applied and before the palladium-nickel deposit was electroplated on the palladium strike layer; no activation treatment was used on the strike-plated surface before the subsequent plating. The result was an equally perfect adhesion between the deposited layers as in Example 1.

EXAMPLE 3

The low-speed acid strike bath of this invention was used on a batch of square contact pins in a barrel-plating operation. The pins were of connector copper alloy with an overall length of 13.5 mm and an overall width of 0.64 mm. The following metal deposits were plated on the pins in sequence and with thicknesses as shown below:

| | |
|---|---|
| Nickel plate | 4.0 μm |
| Acid palladium strike | 0.125 μm |
| Palladium plate | 0.25 μm |
| Hard gold plate | 0.125 μm |

The plated pins were exposed to sulfurous acid vapor in a standard corrosion test procedure (Western Electric Manufacturing Standard 17000, Section 1310) followed by taking an average pore count per square centimeter. It was found to be 25 pores/$cm^2$, as compared to about 200 pores/$cm^2$ when no strike was applied.

EXAMPLE 4

Another batch of the same connecting pins was plated similarly as in Experiment 3, but the palladium deposit was made 0.5 μm thick. In this case, the average pore count of the pins with the palladium strike was 14 pores/$cm^2$, as compared to 80 pores/$cm^2$ without the use of the acid palladium strike.

We claim:

1. An aqueous strike bath for producing a strike electrodeposit of palladium on an electrically conductive surface, which comprises from 0.1 to 30 grams per liter palladium, from 1 to 250 grams per liter of a complexing agent, from 10 to 200 grams per liter of a supporting electrolyte, from 20 to 350 grams per liter of a buffering agent, and from 0 to 50 ppm of a surfactant additive selected from non-ionic and cationic surfactants, which bath exhibits a pH value within a range of from 2.0 to about 4.3, in which said complexing agent comprises an organic diamine selected from the group consisting of 1,2-diaminobutane, 1,2-diaminopropane, 1,2-diamino-2-methylpropane, 1,2-diaminopentane, 1,2-diaminohexane, 2,3-diaminobutane, 2,3-diaminopentane, 2,3-diaminohexane, 3,4-diaminohexane, and higher aliphatic diamines with adjacent primary, secondary or tertiary amino groups, and in which said buffering agent is selected from the group consisting of acetic acid, citric acid, tartaric acid, tetraboric acid, acetoacetic acid, chloracetic acid, maleic acid, malic acid, itaconic acid, and their salts.

2. The bath of claim 1 in which said complexing agent is 1,2-diaminopropane.

3. The bath of claim 1 in which a source of palladium is selected from the group consisting of palladium dichloride, palladium dibromide, palladium sulfate, palladium nitrate, palladium monoxide hydrate, diamminepalladium(II) hydroxide, dichlorodiamminepalladium(II), dinitritodiamminepalladium(II), tetrammine palladium(II) chloride and tetramminepalladium tetrachloropalladate.

4. The bath of claim 1 in which said supporting electrolyte is chosen from the group consisting of chlorides, bromides, sulfates and nitrates of sodium, potassium and ammonia.

5. The bath of claim 3 in which said supporting electrolyte is chosen from the group consisting of chlorides of sodium, potassium and ammonia.

6. The bath of claim 1 in which said buffering agent comprises acetic acid.

7. The bath of claim 1 in which said strike bath, when used for a low-speed plating, comprises 0.1 to 5 grams per liter palladium, 10 to 100 grams per liter of the supporting electrolyte, 1 to 50 grams per liter of the complexing agent, 20 to 200 grams per liter of the buffering agent, 0 to 50 ppm of the surfactant additive, and water to volume, and which exhibits a pH value within a range of from 3.7 to 4.3.

8. The bath of claim 7 in which said strike bath comprises 3±1 grams per liter palladium, 60 grams per liter of the supporting electrolyte, 40 grams per liter of the complexing agent, 150 grams per liter of the buffering agent and 1 ppm of cationic surfactant additive, and which exhibits a pH value of 3.7 to 4.1.

9. The bath of claim 1 in which said strike bath, when used for a highspeed plating, comprises 5 to 30 grams per liter palladium, 20–200 grams per liter of the supporting electrolyte, 50–250 grams per liter of the complexing agent, 200–350 grams per liter of the buffering agent, and 0–50 ppm of the surfactant additive, and water to volume, and which exhibits a pH value within a range of 3.7 to 4.3.

10. The bath of claim 9 in which said strike bath comprises 10±2 grams per liter palladium, 60 grams per liter of the supporting electrolyte, 65 grams per liter of the complexing agent, 250 grams per liter of the buffering agent and 1 ppm of the cationic surfactant additive, and which exhibits a pH value of 3.7 to 4.1.

11. The bath of claim 1 in which said passivated surface is one chosen from the group consisting of nickel, chromium, bronze, and steels.

12. A process of plating an electrically conductive surface, which comprises electroplating on said surface at least two layers in succession comprising a palladium strike layer on said surface and a cover layer comprising a metal selected from the group consisting of palladium nickel alloy and palladium, gold, rhodium, ruthenium, platinum, silver and their alloys, wherein said palladium strike layer is deposited from an aqueous bath comprising from 0.1 to 30 grams per liter palladium, from 1 to 250 grams per liter of a complexing agent, from 10 to 200 grams per liter of a supporting electrolyte, from 50 to 350 grams per liter of a buffering agent, and from 0 to 50 ppm of an additive selected from non-ionic and cationic surfactants, which bath exhibits a pH value within a range of from 2 to about 4.3, in which said complexing agent comprises an organic diamine selected from the group consisting of 1,2-diaminobutane, 1,2-diaminopropane, 1,2-diamino-2-methylpropane, 1,2-diaminopentane, 1,2-diaminohexane, 2,3-diaminobutane, 2,3-diaminopentane, 2,3-diaminohexane, 3,4-diaminohexane, and higher aliphatic diamines with adjacent primary, secondary or tertiary amino groups, and in which said buffering agent is selected from the group consisting of acetic acid, citric acid, tartaric acid, tetraboric acid, acetoacetic acid, chloracetic acid, malic acid, malic acid, itaconic acid, and their salts.

13. The process of claim 12 in which said complexing agent is 1,2-diaminopropane.

14. The process of claim 12 in which a source of palladium is selected from the group consisting of palladium dichloride, palladium dibromide, palladium sulfate, palladium nitrate, palladium monoxide hydrate, diamminepalladium(II) hydroxide, dichlorodiamminepalladium(II), dinitritodiamminepalladium(II), tetramminepalladium(II) chloride and tetramminepalladium tetrachloropalladate.

15. The process of claim 12 in which said supporting electrolyte is chosen from the group consisting of chlorides, bromides, sulfates and nitrates of sodium, potassium and ammonia.

16. The process of claim 15 in which said supporting electrolyte is chosen from the group consisting of chlorides of sodium, potassium and ammonia.

17. The process of claim 12 in which said buffering agent comprises acetic acid.

18. The process of claim 12 in which said strike bath, when used for a low-speed plating, comprises 0.1 to 5 grams per liter palladium, 10 to 100 grams per liter of the supporting electrolyte, 1 to 50 grams per liter of the complexing agent, 20 to 200 grams per liter of the buffering agent, 0 to 50 ppm of the surfactant additive, and water to volume, and which exhibits a pH value within a range of from 3.7 to 4.3.

19. The process of claim 18 in which said strike bath comprises 3±1 grams per liter palladium, 60 grams per liter of a supporting electrolyte, 40 grams per liter of a complexing agent, 150 grams per liter of a buffering agent and 1 ppm of cationic surfactant additive, and which exhibits a pH value of 3.7 to 4.1.

20. The process of claim 12 in which said strike bath, when used for a high-speed plating, comprises 5 to 30 grams per liter palladium, 20–200 grams per liter of the supporting electrolyte, 50–250 grams per liter of the complexing agent, 200–350 grams per liter of the buffering agent, 0 to 50 ppm of the surfactant additive, and water to volume, and which exhibits a pH value within a range of 3.7 to 4.3.

21. The process of claim 20 in which said strike bath comprises 10±2 grams per liter palladium, 60 grams per liter of the supporting electrolyte, 65 grams per liter of the complexing agent, 250 grams per liter of the buffering agent and 1 ppm of the cationic surfactant additive, and which exhibits a pH value of 3.7 to 4.1.

22. The process of claim 12 in which said electrically conductive surface is one chosen from the group consisting of nickel, chromium, bronze, and steels.

23. A process of plating palladium strike on an electrically conductive surface of an article comprising the step of passing current through an article acting as a cathode, an aqueous strike bath and an anode, wherein the pH of the strike bath ranges from 2 to about 4.3, the strike bath comprises from 0.1 to 30 grams per liter palladium, from 1 to 250 grams per liter of a complexing agent, from 10 to 200 grams per liter of a supporting electrolyte, from 20 to 350 grams per liter of a buffering agent, and from 0 to 50 ppm of a surfactant additive selected from non-ionic and cationic surfactants, said complexing agent comprises an organic diamine selected from 1,2-diaminobutane, 1,2-diaminopropane, 1,2-diamino-2-methylpropane, 1,2-diaminopentane, 1,2-diaminohexane, 2,3-diaminobutane, 2,3-diaminopentane, 2,3-diaminohexane, 3,4-diaminohexane and higher aliphatic diamines with adjacent primary, secondary or tertiary amino groups, and said buffering agent is selected from the group consisting of acetic acid, citric acid, tartaric acid, tetraboric acid, acetoacetic acid, chloracetic acid, malic acid, malic acid, itaconic acid, and their salts.

* * * * *